US007219766B2

(12) United States Patent
Deuer

(10) Patent No.: US 7,219,766 B2
(45) Date of Patent: May 22, 2007

(54) MID-SPAN FALL PROTECTION SYSTEM

(76) Inventor: Joseph F. Deuer, 560 W. David Rd., Kettering, OH (US) 45429

( * ) Notice: Subject to any disclaimer, the term of this patent is extended or adjusted under 35 U.S.C. 154(b) by 378 days.

(21) Appl. No.: 10/880,015

(22) Filed: Jun. 29, 2004

(65) Prior Publication Data

US 2005/0284703 A1 Dec. 29, 2005

(51) Int. Cl.
*E06C 1/36* (2006.01)
*E06C 7/42* (2006.01)

(52) U.S. Cl. ..... 182/206; 182/107; 182/10

(58) Field of Classification Search ..... 182/206, 182/36, 3, 107, 191, 214, 60
See application file for complete search history.

(56) References Cited

U.S. PATENT DOCUMENTS

| | | | | | |
|---|---|---|---|---|---|
| 119,161 | A | * | 9/1871 | Luckenbach et al. | 182/206 |
| 283,530 | A | | 8/1883 | Swartz | |
| 334,237 | A | * | 1/1886 | Ketchum | 182/206 |
| 1,018,877 | A | | 2/1912 | Chickering | |
| 1,961,289 | A | | 6/1934 | Gardner | |
| 2,432,781 | A | | 12/1947 | Mann | |
| 2,448,716 | A | | 9/1948 | Hurd | |
| 2,629,532 | A | * | 2/1953 | Tupper et al. | 182/206 |
| 3,001,603 | A | | 9/1961 | Kraus, Jr. | |
| 3,590,951 | A | | 7/1971 | Berger | |
| 3,780,829 | A | * | 12/1973 | Wallingford | 182/206 |
| 4,089,390 | A | | 5/1978 | McLain | |
| 4,090,587 | A | | 5/1978 | Pyle | |
| RE30,072 | E | | 8/1979 | Kleine et al. | |
| 4,423,796 | A | | 1/1984 | Sulowski et al. | |
| 4,434,871 | A | * | 3/1984 | Niedworok | 182/206 |
| 4,545,460 | A | | 10/1985 | Byrd | |
| 4,694,934 | A | * | 9/1987 | Erickson | 182/206 |
| 5,054,581 | A | * | 10/1991 | Henson | 182/206 |
| 5,350,037 | A | * | 9/1994 | Ghahremani | 182/3 |
| 5,460,240 | A | | 10/1995 | Jones | |
| 5,529,145 | A | | 6/1996 | Allred | |
| 6,044,930 | A | | 4/2000 | Hayman | |
| 6,167,988 | B1 | | 1/2001 | Frodge et al. | |

* cited by examiner

*Primary Examiner*—Hugh B. Thompson, II
(74) *Attorney, Agent, or Firm*—Stevens & Showalter LLP

(57) ABSTRACT

A mid-span fall protection system including a remotely attachable fall protection latching mechanism for attachment to an elevated horizontal strand. The fall protection latching mechanism may be used with an elongated rigid structure for extending between a support surface and the elevated horizontal strand, where the fall protection latching mechanism is attached to an upper end of the elongated rigid structure. The fall protection latching mechanism includes a hook portion for engaging over the elevated horizontal strand to provide a support for the fall protection latching mechanism, and a fall protection line coupling structure attached to the hook portion for providing a direct connection between the hook portion and a fall protection line. A fall protection line is also provided having an upper end attached to and supported by the coupling structure, and includes a lower end located adjacent a lower end of the elongated rigid structure at the support surface. The fall protection line provides a connection between the fall protection latching mechanism and a worker moving vertically along the elongated rigid structure.

18 Claims, 3 Drawing Sheets

MID-SPAN FALL PROTECTION SYSTEM

BACKGROUND OF THE INVENTION

1. Field of the Invention

The present invention relates to safety devices, and more particularly, to a fall protection system for providing fall protection to persons working mid-span on horizontal structures, such as a horizontal strand.

2. Description of the Prior Art

Workers, such as linemen, employed to perform operations on horizontally extending lines typically prop a ladder adjacent a location of the line requiring work, where the line is used as an upper support for the ladder. The danger inherent in climbing and working on lines using a ladder is well known, in that the ladder may shift while in use, and particularly when the worker is ascending or descending the ladder. In addition, such lines are subject to oscillating movement which can cause instability in the ladder and increased danger to a worker due to movement of the line.

Generally, the prior art has recognized the importance of providing a secure connection between a ladder and a line providing a support for the ladder. See, for example, U.S. Pat. Nos. 5,054,581 and 5,529,145. Further, it should be noted that some known worker support constructions rely on a connection to the ladder to support the worker, and thus the degree of safety provided to the worker will vary with the integrity of the ladder construction and will further depend on the reliability of the connection between the ladder and the supporting elevated line.

Although several prior art devices suggest constructions for maintaining a desired position for ladders utilized in combination with elevated lines, and devices for attachment to workers for securing the worker in various ways to the ladder structure, there remains a need for providing fall protection to a worker in situations where the worker is climbing a ladder, as well as when the worker is in position to perform a task at an elevated location. In particular, there is a need for a fall protection system which directly associates a worker with the elevated support line and which ensures that the connecting components of the fall protection system connecting the worker to the elevated line meet or exceed fall protection standards, such as the ANSI Z.359 or ANSI A-14.3 standards, which relate to loads applied against the system in the event a fall by the worker is arrested by the system. There is a further need for providing a fall protection system which can be secured prior to the worker ascending to the elevated work location, such that the fall protection system may be implemented throughout the time a worker is at risk.

SUMMARY OF THE INVENTION

In accordance with one aspect of the invention, a mid-span fall protection system is provided comprising a remotely attachable fall protection latching mechanism for attachment to an elevated horizontal strand. The fall protection latching mechanism may be used with an elongated rigid structure for extending between a support surface and the elevated horizontal strand, where the fall protection latching mechanism is attached to an upper end of the elongated rigid structure. The fall protection latching mechanism includes a hook portion for engaging over the elevated horizontal strand to provide a support for the fall protection latching mechanism, and a fall protection line coupling structure attached to the hook portion for providing a direct connection between the hook portion and a fall protection line. A fall protection line is also provided having an upper end attached to and supported by the coupling structure, and includes a lower end located adjacent a lower end of the elongated rigid structure at the support surface. The fall protection line provides a connection between the fall protection latching mechanism and a worker moving vertically along the elongated rigid structure.

In accordance with another aspect of the invention, a mid-span fall protection system is provided comprising first and second remotely attachable fall protection latching mechanisms for attachment to an elevated horizontal strand. The fall protection latching mechanisms may be used with an elongated ladder structure for extending between a support surface and the elevated horizontal strand. The first and second fall protection latching mechanisms may be attached to opposing sides of an upper end of the ladder structure. The fall protection latching mechanisms include a hook portion for engaging over the elevated horizontal strand to provide a support for the fall protection latching mechanism and to provide a support for the ladder structure, and include a fall protection line coupling structure connected to the hook portion of at least one of the fall protection latching mechanisms for providing a direct connection between the hook portion and a fall protection line. A fall protection line is also provided having an upper end attached to and supported by the coupling structure, and includes a lower end located adjacent a lower end of the ladder structure at the support surface. The fall protection line provides a connection between at least one of the fall protection latching mechanisms and a worker moving vertically along the ladder structure.

Other features and advantages of the invention will be apparent from the following description, the accompanying drawings and the appended claims.

DETAILED DESCRIPTION OF THE INVENTION

Figure 1:
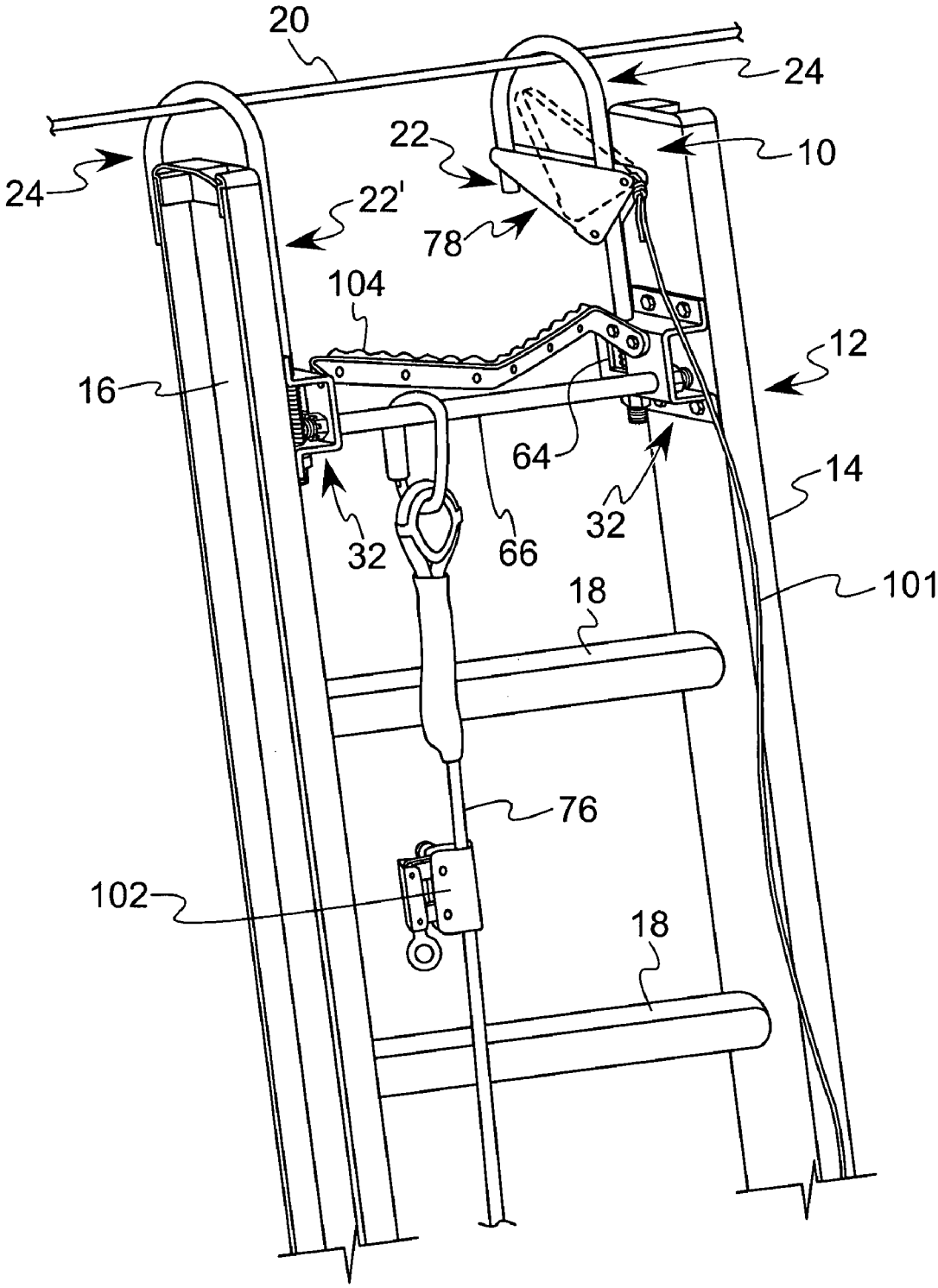
FIG. 1 is a perspective view of the fall protection system in accordance with the present invention illustrated incorporated on a ladder in association with a horizontal strand.

Referring to FIG. 1, a mid-span fall protection system 10 in accordance with the present invention is shown in combination with an elongated rigid structure illustrated in the form of a ladder 12 having a pair of side rails 14, 16 and a plurality of rungs 18 extending horizontally between the side rails 14, 16, the ladder 12 being adapted to extend between a substantially horizontal surface and a vertically spaced, horizontally extending strand 20, such as a cable or power line. However, it should be understood that the concept embodied by the illustrated fall protection system 10 may be incorporated with other rigid structures for extending vertically to a horizontal strand 20 in order to locate the fall protection system 10 in an operable position. The fall protection system 10 is shown attached to the upper end of the elongated rigid structure whereby remote attachment of the fall protection system 10 to the horizontal strand 20 is facilitated.

Figure 2:
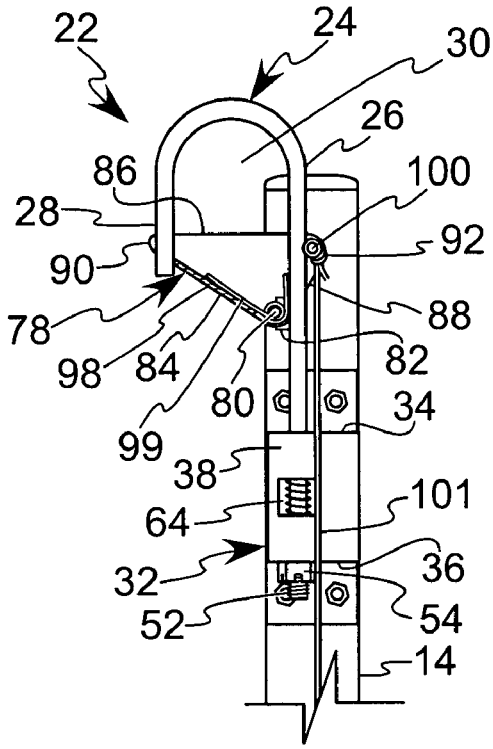
FIG. 2 is a side elevational view of one of the latching mechanisms showing the latch member in cross-section.

Referring to FIG. 2, the fall protection system 10 comprises a latching mechanism 22 including a hook portion 24 for engaging over the horizontal strand 20 to provide a support for the fall protection system 10. In one embodiment, the hook portion 24 comprises a unitary member, such as may be formed of a metal bar, i.e., 6061-T6 aluminum round bar, bent approximately 180 to define substantially parallel legs where one of the legs comprises a long leg 26 and the other of the legs comprises a short leg 28, and a concave interior area 30 is defined between the two legs 26, 28 for receiving the horizontal strand 20.

Figure 3:
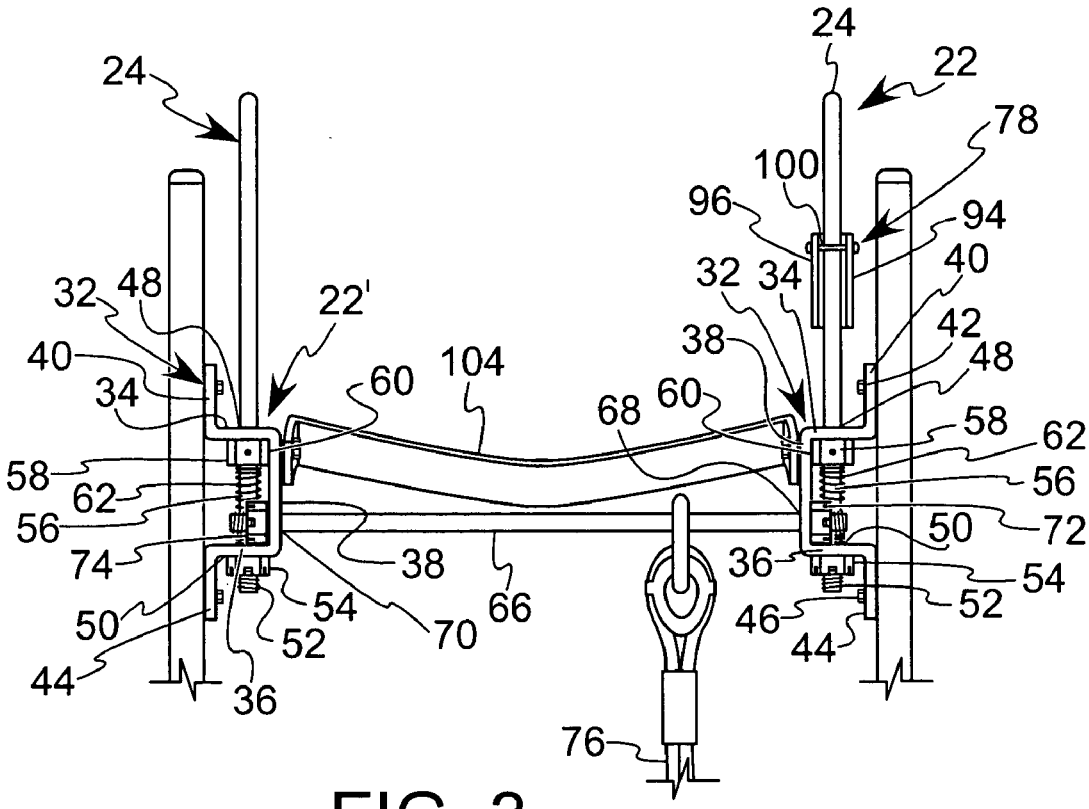
FIG. 3 is a front elevational view of the fall protection system illustrated incorporated on a ladder with the hook portions positioned for engaging a horizontal strand.

The hook portion 24 is attached to a ladder side rail 14 by a bracket 32 which bolts to an inside portion of the ladder side rail 14. Referring further to FIG. 3, the bracket 32 generally defines a U-shaped member including an upper wall 34 and a lower wall 36 and a side wall 38 spanning between and connecting the upper and lower walls 34, 36. The upper wall 34 includes an upper flange portion 40 for receiving bolts 42 to connect the upper wall 34 to the ladder side rail 14, and the lower wall 36 includes a lower flange portion 44 for receiving bolts 46 to connect the lower wall 36 to the ladder side rail 14. Connection of the upper and lower walls 34, 36 of the bracket 32 to the ladder side rail 14 positions the side wall 38 of the bracket 32 parallel to the inside portion of the ladder side rail 14.

The upper and lower bracket walls 34, 36 include respective apertures 48, 50 sized to receive the long leg 26 of the hook portion 24. The long leg 26 of the hook portion 24 extends downwardly through the apertures 48, 50 in the bracket 32 and includes a lower end comprising a lower threaded portion 52 extending downwardly from the lower wall 36 of the bracket 32. A nut 54 is threaded on the lower threaded portion 52 and is adapted to engage a lower surface of the lower wall 36 of the bracket 32. An intermediate portion 56 of the long leg 26 of the hook portion 24 is located between the upper and lower walls 34, 36 of the bracket 32, and a spring seat comprising a square nut 58 is rigidly attached to the intermediate portion of the long leg 26. The square nut 58 is positioned such that a side 60 of the square nut 58 is normally parallel and closely adjacent to the side wall 38 of the bracket 32, preventing rotation of the square nut 58 and thus preventing rotation of the hook portion 24. A spring 62 located between the square nut 58 and the lower wall 36 of the bracket 32 acts on the nut 58 to bias the hook portion 24 upwardly relative to the bracket 32 to a rest position for the nut 58 (FIG. 3).

Figure 4:
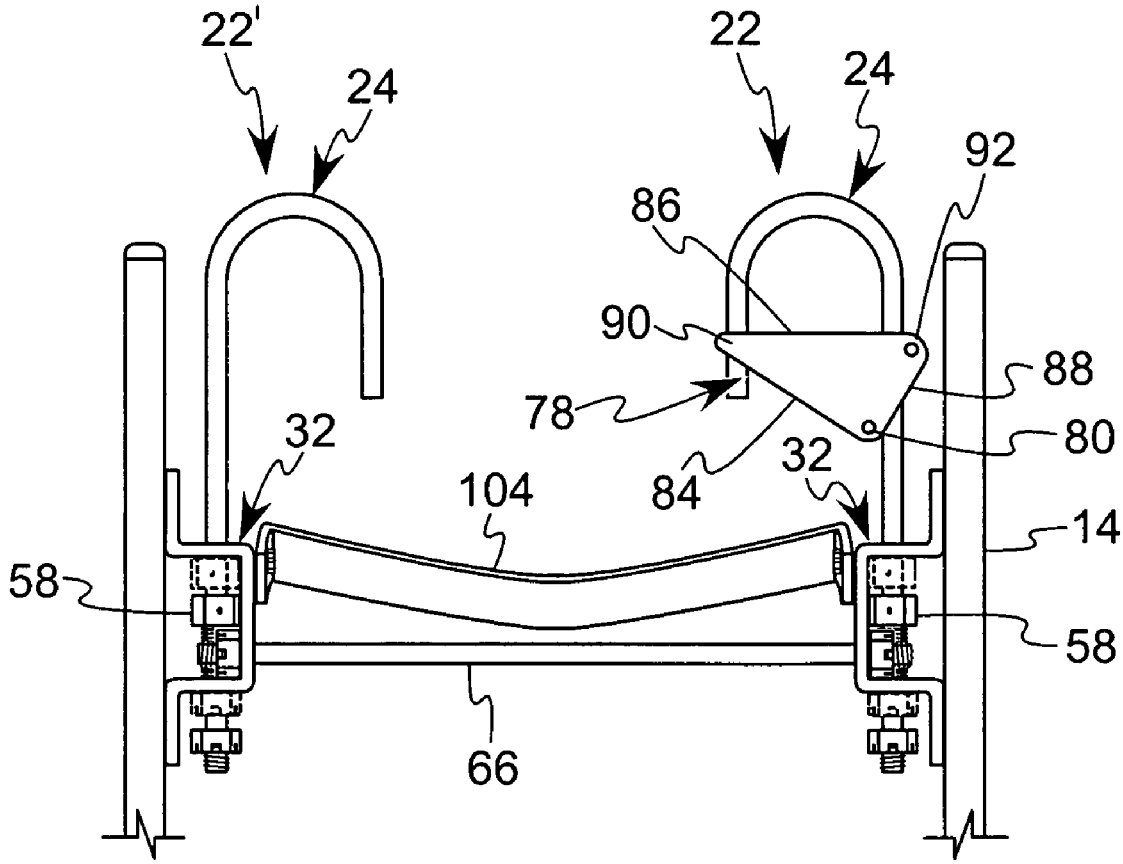
FIG. 4 is a front elevational view of the fall protection system illustrated incorporated on a ladder with the hook portions positioned 90 relative to the position shown in FIG. 3.

The bracket 32 includes a cut-out or slot area 64 (FIG. 2) below the rest position, and the hook portion 24 may be pushed into the bracket 32 to align the square nut 58 with the slot 64, as illustrated by the dotted line position of the nut 58 in FIG. 4, which provides clearance for the sides of the nut 58 to permit the nut 58 to rotate relative to the bracket 32. Accordingly, the hook portion 24 may be rotated relative to the bracket 32 and the ladder side rail 14, and may be pivoted about an axis generally parallel to the direction of elongation of the ladder 12. The spring force applied to the square nut 58 on the hook portion 24 normally biases the hook portion 24 and associated nut 58 to its rest position whereby the hook portion 24 is maintained in a desired rotational position. The square nut 58 permits the hook portion 24 to be located at different positions oriented 90 from each other. For example, the hook portion 24 may be rotated such that a plane defined by the hook portion legs 26, 28 is parallel to the plane of the ladder side rail 14 when the fall protection system 10 is positioned for use to engage the horizontal strand 20, and the hook portion 24 may be rotated 90 to extend perpendicular to the use position for transportation of the fall protection system 10 when not in use, as illustrated in FIG. 4.

In a typical configuration of the fall protection system 10, first and second latching mechanisms 22, 22' are provided attached to opposing side rails 14, 16 of a ladder 12, where elements of the second latching mechanism 22' corresponding to elements of the first latching mechanism 22 are labeled with the same reference numerals. A coupling mechanism comprising a lateral bar 66 is further provided having ends 68, 70 extending through apertures in the side walls 38 of the brackets 32. Each end 68, 70 of the lateral bar 66 is threaded and receives a respective nut 72, 74, such that the first and second latching mechanisms 22, 22' and the lateral bar 66 comprise a structural unit. The lateral bar 66 is adapted to receive a worker safety line, such as by attachment of a fall protection line 76 to the lateral bar 66. Thus, the fall protection system 10 provides a direct connection between a fall protection line 76 for a worker and the horizontal strand 20, which is typically a mid-span location on a line for conducting power or electrical signals, requiring maintenance or other operations by the worker at an elevated location.

The latching mechanism 22 comprising the hook portion 24, and including the coupling for the safety line 76, is rated to withstand a dynamic force which may occur in the event of a fall by a worker attached to the fall protection system 10, such as a fall from a ladder 12 associated with the fall protection system 10. Specifically, the fall protection system 10 is constructed to withstand a 2500 lb. stress test force, as required by the ANSI Z.359 and ANSI A-14.3 standards, and is accomplished in the illustrated construction by avoiding intermediate structural connections between the hook portion 24 and the coupling structure for the safety line 76. In particular, the connection to the safety line 76 does not depend on an intermediate connection to a ladder 12 or similar structure.

As seen in FIG. 2, the latching mechanism 22 of the fall protection system 10 may further include a latch member 78 for closing the passage to the interior area 30 between the two legs of the hook portion 24. The latch member 78 is supported at a pivot point 80 defined on a support block 82 on the long leg 26, and the latch member 78 pivots about the pivot point 80. The latch member 78 comprises a first side 84, a second side 86 and a third side 88 connected to each other to define a triangular shaped member. The first side 84 defines an outer surface extending from a location near the pivot point 80 to a distal point 90 for cooperating with the short leg 28 of the hook portion 24. The second side 86 defines an interior surface adjacent the interior area 30 extending from the distal point 90 toward a leverage point 92, and the third side 88 extends between the pivot point 80 and the leverage point 92. The first, second and third sides 84, 86, 88 are defined by first and second parallel plates 94, 96 (FIG. 3) which are spaced apart to receive the lateral sides of the hook portion legs 26, 28 therebetween. The plates 94, 96 are held in spaced relation by a connecting wall 98 (FIG. 2) integrally connected to the first and second plates 94, 96 and extending along a portion of the first side 84. In addition, the leverage point 92 is defined by a laterally extending pin element 100 (FIG. 3) connecting the first and second plates 94, 96 and located on a side of the long leg 26 opposite from the interior area 30.

The outer surface of the first side 84 is adapted to engage the horizontal strand 20 when locating the fall protection system 10 in place, such as by positioning the hook portion 24 over the horizontal strand 20, causing the latch member 78 to pivot inwardly to permit movement of the horizontal strand 20 into the interior area 30. The interior surface of the second side 86 is adapted to engage the horizontal strand 20, when the horizontal strand 20 is located within the interior area 30, and prevent the horizontal strand 20 from becoming disengaged from the interior area 30. The first and second plates 94, 96 are located on either lateral side of the short leg 28 of the hook portion 24 when the latch member 78 is in the closed position to prevent the horizontal strand 20 from passing out of engagement with the interior area 30, and a spring 99 is provided at the pivot point 80 for biasing the latch member 78 toward the closed position.

Movement of the latch member 78 toward the closed position is limited by engagement of the connecting wall 98 with the short leg 28, which also prevents the latch member 78 from opening the interior area 30 in response to engagement of the horizontal strand 20 on the second or interior surface 86. Thus, the latch member 78 is movable to allow the hook portion 24 to be remotely engaged on the horizontal strand 20, and the latch member 78 prevents removal of the hook portion 24 from the horizontal strand 20 during engagement of the horizontal strand 20 against the inside surface of the latch member 78.

When disengagement of the hook portion 24 from the horizontal strand 20 is required, such as when disengaging the fall protection system 10 from the horizontal strand 20, the latch member 78 may be manually pivoted to the open position. Specifically, a rope 101 or other actuating structure may be attached to the latch member 78 at or adjacent to the leverage point 92. A force applied downwardly to the leverage point 92, such as by pulling the rope 101, causes the distal point 90 of the latch member 78 to pivot upwardly and into the interior area 30, opening the interior area 30 to permit passage of the horizontal strand 20 out of engagement with the hook portion 24, as illustrated by the dotted line position of the latch member 78 in FIG. 1. Thus, the fall protection system 10 may be remotely detached from the horizontal strand 20 by actuation of the rope 101 attached to the latch member 78, such as may be actuated by a person standing on the ground below the mounting location of the system.

In one application of the fall protection system 10, a latching mechanism 22 may be provided adjacent the upper end of each side rail 14, 16 of the ladder 12. One of the latching mechanisms 22 may be provided with a latch member 78, while the other latching mechanism 22' may include the hook portion 24 without a latch member. In the illustrated embodiment, the above-described lateral bar 66 is shown extending between the two latching mechanisms 22, 22' and provides a safety line attachment location, where a worker may attach a security device 102 to the safety line 76 for securing the worker to the safety line 76 and for permitting the worker to move vertically along the safety line 76. Such a security device preferably is auto-latching/locking for gripping the safety line 76, and which requires manual release for removal. An example of such a security device 102 is described in U.S. Pat. No. 5,855,251, which patent is incorporated herein by reference. It should be noted that the one latch member 78 on the first latching mechanism 22 is sufficient to ensure fall protection in that, even if the second latching mechanism 22' should become disengaged from the horizontal strand 20, the safety line 76 will remain connected to the horizontal strand 20 through the connection of the first latching mechanism 22 on the horizontal strand 20. Further, the direct connection of the safety line 76 to the latching mechanism 22 ensures that the maximum rating fall protection provided through the present system is available at the safety line 76, avoiding weak points that may occur through attachment of the safety line 76 via the ladder 12 or other intermediate structures.

The fall protection system 10 may further be provided with a brace member 104 for engaging vertical structures, such as utility poles. The brace member 104 extends laterally between the latching mechanisms 22, 22', and is attached to the brackets 32 of the latching mechanisms 22, 22' above the lateral bar 66. The brace member 104 is formed of a bar or strap in a generally V-shape for accommodating the curved outer surface of the vertical structure. The rigid brace may be secured to the vertical structure by a cable extending around the vertical structure and attached to the latching mechanisms 22, 22'.

From the above-description, it should be understood that the hook portions 24 and lateral bar 66 operate to provide an independent fall protection anchorage connector that can be used in conjunction with a vertical safety or life line to facilitate an OSHA/ANSI load rated fall protection system.

It should be understood that the latching mechanism 22 could be attached to the end of a pole to enable the latching mechanism 22 to be connecting to an elevated location, and that the climbing structure, such as a ladder, may be provided separately. For example, the lower end of the hook portion 24 of the latching mechanism 22 may be provided with an eye-ring (not shown) receiving the safety line of a worker, permitting independent attachment of the latching mechanism 22 to an elevated location prior to the worker ascending to the elevated location.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A mid-span fall protection system comprising:

a remotely attachable fall protection latching mechanism for attachment to an elevated horizontal strand;

an elongated rigid structure for extending between a support surface and said elevated horizontal strand, said fall protection latching mechanism attached to an upper end of said elongated rigid structure;

said fall protection latching mechanism including:

a hook portion for engaging over said elevated horizontal strand to provide a support for said fall protection latching mechanism; and a fall protection line coupling structure attached to said hook portion for providing a direct connection between said hook portion and a fall protection line; and a fall protection line having an upper end attached to and supported by said coupling structure, and having a lower end located adjacent a lower end of said elongated rigid structure at said support surface, said fall protection line providing a connection between said fall protection latching mechanism and a worker moving vertically along said elongated rigid structure; and wherein said coupling structure is adapted to provide a connection between said fall protection line and said elevated horizontal strand independently of said elongated rigid structure.

2. The fall protection system of claim 1 wherein said fall protection latching mechanism provides a connection for attachment of said elongated rigid structure to said elevated horizontal strand.

3. The fall protection system of claim 1 wherein said hook portion comprises a unitary bar bent in a generally U-shape for engaging over the elevated horizontal strand and said coupling structure is connected to one leg of said U-shape.

4. The fall protection system of claim 1 wherein said fall protection latching mechanism comprises a movable latch member for closing an opening in said hook portion provided for receiving said elevated horizontal strand.

5. The fall protection system of claim 4 wherein said movable latch member comprises a pivoting member biased into a position closing said opening, and having an outer surface for engagement with said elevated horizontal strand to cause said movable latch member to pivot inwardly to an open position to permit passage of said elevated horizontal strand into engagement with said hook portion.

6. The fall protection system of claim 5 including a remote actuator attached to said movable latch member for actuating said movable latch member from a location adjacent said lower end of said elongated rigid structure.

7. The fall protection system of claim 1 wherein said elongated rigid structure comprises a ladder.

8. A mid-span fall protection system comprising:

a remotely attachable fall protection latching mechanism for attachment to an elevated horizontal strand;

an elongated rigid structure for extending between a support surface and said elevated horizontal strand, said fall protection latching mechanism attached to an upper end of said elongated rigid structure;

said fall protection latching mechanism including:

a hook portion for engaging over said elevated horizontal strand to provide a support for said fall protection latching mechanism; and a fall protection line coupling structure attached to said hook portion for providing a direct connection between said hook portion and a fall protection line; and a fall protection line having an upper end attached to and supported by said coupling structure, and having a lower end located adjacent a lower end of said elongated rigid structure at said support surface, said fall protection line providing a connection between said fall protection latching mechanism and a worker moving vertically along said elongated rigid structure, and including an auto-latching/locking mechanism located on said fall protection line.

9. The fall protection system of claim 8 wherein said auto-latching/locking mechanism requires manual release for removal from said fall protection line.

10. A mid-span fall protection system comprising:

first and second remotely attachable fall protection latching mechanisms for attachment to an elevated horizontal strand;

an elongated ladder structure for extending between a support surface and said elevated horizontal strand, said first and second fall protection latching mechanisms attached to opposing sides of an upper end of said ladder structure;

said fall protection latching mechanisms including:

a hook portion for engaging over said elevated horizontal strand to provide a support for said fall protection latching mechanism and to provide a support for said ladder structure; and a fall protection line coupling structure connected to said hook portion of at least one of said fall protection latching mechanisms for providing a direct connection between said hook portion and a fall protection line; and a fall protection line having an upper end attached to and supported by said coupling structure, and having a lower end located adjacent a lower end of said ladder structure at said support surface, said fail protection line providing a connection between at least one of said fall protection latching mechanisms and a worker moving vertically along said ladder structure.

11. The fall protection system of claim 10 wherein said coupling structure is adapted to provide a connection between said fall protection line and said elevated horizontal strand independently of said ladder structure.

12. The fall protection system of claim 10 wherein said hook portions each comprise a unitary bar bent in a generally U-shape for engaging over the elevated horizontal strand and said coupling structure is connected to one leg of said U-shape.

13. The fall protection system of claim 12 wherein said coupling structure includes a lateral coupling element extending between and connected to each of said latching mechanisms, and said fall protection line is supported on said lateral coupling element.

14. The fall protection system of claim 10 wherein at least one of said fall protection latching mechanisms comprises a movable latch member for closing an opening in said hook portion provided for receiving said elevated horizontal strand.

15. The fall protection system of claim 14 wherein said movable latch member comprises a pivoting member biased into a position closing said opening, and having an outer surface for engagement with said elevated horizontal strand to cause said movable latch member to pivot inwardly to an open position to permit passage of said elevated horizontal strand into engagement with said hook portion.

16. The fall protection system of claim 15 including a remote actuator attached to said movable latch member for enabling actuation of said movable latch member by movement of said remote actuator at a location adjacent said lower end of said ladder structure.

17. The fall protection system of claim 10 including a brace member attached to and extending between said first and second latching mechanisms for engaging and supporting said ladder structure on a vertical post structure.

18. The fall protection system of claim 10 wherein said first and second latching mechanisms each include a bracket attached to a respective leg of said ladder structure and said hook portions of said first and second latching mechanisms are supported on respective brackets and are pivotally movable about axes generally parallel to a direction of elongation of said ladder structure whereby said hook portions are pivotable through at least about 90° of movement.

* * * * *